US005267882A

United States Patent [19]

Davis

[11] Patent Number: 5,267,882

[45] Date of Patent: Dec. 7, 1993

[54] SET OF KEYED ELECTRICAL CONNECTORS

[75] Inventor: Wayne S. Davis, Harrisburg, Pa.

[73] Assignee: The Whitaker Corporation, Wilmington, Del.

[21] Appl. No.: 988,627

[22] Filed: Dec. 10, 1992

[51] Int. Cl.[5] ..... H01R 13/64

[52] U.S. Cl. ..... 439/680; 439/610

[58] Field of Search ..... 439/677, 680, 676, 681, 439/218, 217, 222, 607, 609, 610

[56] References Cited

U.S. PATENT DOCUMENTS

| | | | |
|---|---|---|---|
| 3,491,330 | 1/1970 | Barnhart et al. | 339/184 |
| 3,594,696 | 7/1971 | Witek, Jr. | 439/680 |
| 4,047,781 | 9/1977 | DeNigris et al. | 439/218 |
| 4,403,824 | 9/1983 | Scott | 439/680 |
| 4,457,575 | 7/1984 | Davis et al. | 339/143 R |
| 5,017,156 | 5/1991 | Sugiyama | 439/607 |
| 5,044,994 | 9/1991 | Van Wolnsel | 439/681 |

FOREIGN PATENT DOCUMENTS

| | | | |
|---|---|---|---|
| 554477 | 2/1930 | Fed. Rep. of Germany | 22/22 C |
| 616550 | 2/1930 | Fed. Rep. of Germany | 21/22 C |

*Primary Examiner*—Larry I. Schwartz
*Assistant Examiner*—Hien D. Vu

[57] ABSTRACT

A set of keyed electrical connectors consists of a first plug connector (2) a second plug connector (4), a first receptacle connector (6) and a second receptacle connector (8). The first and second plug connectors (2,4) have shielded mating plug portions (21,38) and the first and second receptacle connectors have metal shielding shells (56,60) for receiving respective mating plug portions (28,38) of the plug connectors (2,4). The first plug connector (2) is connected to a first cable (MC1), the second plug connector (4) being connected to a second cable (MC2) which is shorter than the first cable. The receptacle connectors (6,8) are surface mounted and are connected to respective printed circuits. The plug portions and the shielding shells have chamfered keying surfaces (26,42,44,120,126,130) which are so arranged that the plug portion (21) of the first plug connector (2) can be mated only with the shielding shell (56) of the first receptacle connector (6) whereas the plug portion (38) of the second plug connector (4) can be mated, as required, with the shielding shell of either of the receptacle connectors (6,8). The cables (MC1,MC2) are connected to different electronic circuits.

20 Claims, 6 Drawing Sheets

SET OF KEYED ELECTRICAL CONNECTORS

BACKGROUND OF THE INVENTION

This invention relates to a set of keyed electrical connectors comprising a first and a second plug connector and a first and a second receptacle connector. The invention particularly, but not exclusively, concerns such a set of connectors which are shielded in respect of electro-magnetic induction.

U.S. Pat. No. 4,457,575, for example, discloses a keying system for shielded plug and receptacle electrical connectors, in which keys in the form of ribs and complimentary keyways therefor are provided on the dielectric housings of the connectors and are located to ensure that only an individual receptacle connector can be mated with a specific plug connector. There is disclosed in U.S. Pat. No. 3,491,330 shielded rectangular plug and receptacle connectors having corners thereof chamfered for polarizing purposes, that is to say, for ensuring that the plug and a receptacle connector can be mated only in a predetermined orientation relative to each other. The German Patent 554,477 discloses a set of unshielded plug and socket connectors having on the housings thereof, keys and corresponding keyways, in the form of ribs and grooves, for keying particular plugs to particular sockets. Some of the plugs are mateable with more than one of the sockets. There is disclosed in U.S. Pat. No. 5,017,156, a shielded plug connector and a shielded receptacle connector, the receptacle connector comprising a metal shielding shell containing an assembly of electrical terminals, the shielding shell acting as a mating portion of the receptacle connector, for receiving the shielded plug connector.

There are some applications, for example, in the computer industry, where a first circuit is required to be connectable only to a second circuit and a third circuit is required to be connectable not only to the first circuit but alternatively to a fourth circuit. For example, one of a pair of surface mount electrical receptacle connectors the terminals of each of which are connected to a respective printed circuit, may be required to be capable of receiving only one of a pair of plug connectors each connected to a different circuit, remote from the receptacle connectors, by means of a cable of a particular length, whereas the other receptacle may be required to be capable of receiving either one of the plug connectors, as needed.

An object of the present invention is to provide a set of plug and socket electrical connectors which is suitable for use in an application of the kind outlined above.

SUMMARY OF THE INVENTION

According to one aspect of the invention, a set of keyed electrical connectors each having electrical terminals secured therein, comprises a first and a second plug connector and a first and a second receptacle connector. Each plug connector has a mating plug portion and each receptacle connector has a mating receptacle portion for mating with the mating portion of a respective plug connector in order to mate the electrical terminals of the plug connector with those of the receptacle connector. The mating portions of the connectors are formed with lateral, chamfered keying surfaces which are located to allow terminals of the first plug connector to be mated only with the terminals of the first receptacle connector, but to allow the terminals of the second plug connector to be mated either with the terminals of the first receptacle connector or with the terminals of the second receptacle connector.

Such chamfered lateral keying surfaces can readily be formed on the mating portions of the plug connectors without the use of small cross section, and thus fragile, mould cores of the type needed for providing rib and groove keying structures. Each mating portion will be of substantially rectangular cross section, the mating portion of the first plug connection and the mating portion of the first receptacle connector having one chamfered corner, the mating portion of the second plug connector and the mating portion of the second receptacle connector each having two opposed chamfered corners at the same end of the cross section, which are oppositely angled.

According to another aspect of the invention, a set of keyed electrical connectors each having electrical terminals secured therein, comprises a first and a second plug connector and a first and a second receptacle connector. Each plug connector has a shielded mating plug portion and each receptacle connector has a metal shielding shell for receiving the mating portion of a respective plug connector in a mating direction to mate the electrical terminals of the plug connector with those of the receptacle connector. The mating portions of the plug connectors and the shielding shells of the receptacle connectors are formed with keying surfaces which are inclined transversely of the mating direction and are located to allow the mating portion of the first plug connector to be received in the shielding shell of the first receptacle connector, to prohibit the mating portion of the first plug connector from being received in the shielding shell of the second receptacle connector and to allow the mating portion of the second plug connector to be received either in the shielding shell of the first receptacle connector or in the shielding shell of the second receptacle connector.

Neither the plug connector shields nor the receptacle connector shields need to be formed with rib and groove keying structures but can readily be provided with the required inclined keying surfaces and can each conveniently be rolled up from a single sheet metal bank.

In use, the terminals of the first plug connector may be connected to respective wires of a first electrical cable, the terminals of the second plug connector being connected to respective wires of a second electrical cable, one of the cables being longer than the other, each of the receptacle connectors being surface mounted on a circuit board and the terminals of the first and second receptacle connectors being connected to respective discrete electrical circuits.

DETAILED DESCRIPTION OF THE PREFERRED EMBODIMENT OF THE INVENTION

A shielded electrical connector assembly for use in connecting the wires of multi-wire electrical cables to circuitry on a printed circuit board PCB (FIG. 7) comprises a first shielded electrical plug connector 2, a second shielded electrical plug connector 4, a first shielded, surface mount electrical receptacle connector 6 and a second shielded surface mount electrical receptacle connector 8 which will also be mounted on the board PCB or on a similar board but in any event being connected to a different circuit from that of the first receptacle connector 6.

Figure 1:
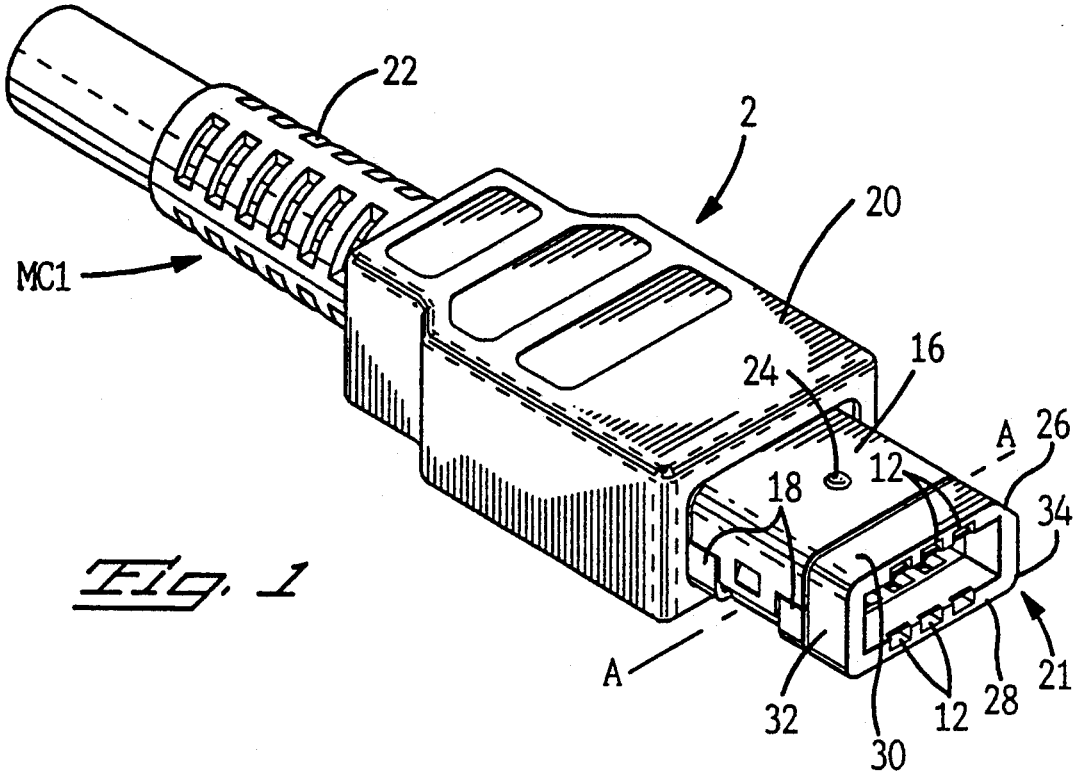
FIG. 1 is an isometric view of a first shielded electrical plug connector according to the preferred embodiment of the invention, to which has been terminated a relatively long electrical cable only part of which is shown.
Figure 2:
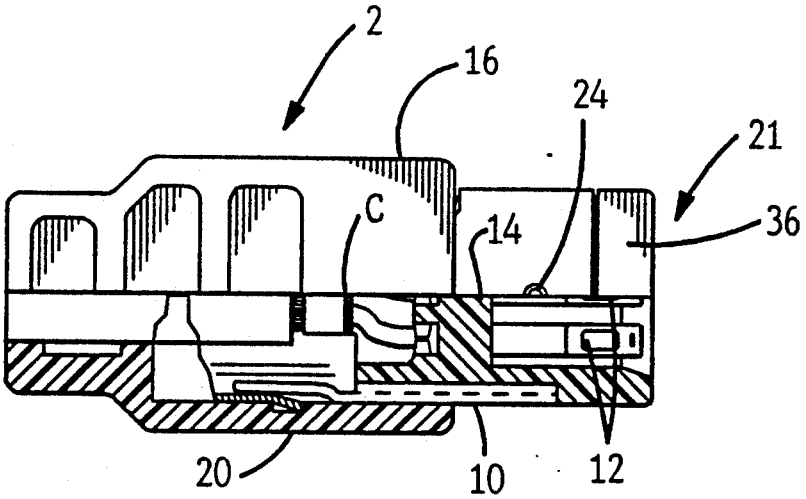
FIG. 2 is a fragmentary top plan view, shown partly in section, of the plug connector FIG. 1.

The first plug connector 2 comprises, as shown in FIGS. 1 and 2, a dielectric housing 10 containing two superposed rows of electrical contact elements having reversely bent mating contact springs 12 projecting forwardly from a mating face 14 of the housing 10 and connected to wires C of a multi-wire electrical cable MC1. An EMI metal shield 16 is secured about the housing 10 by means of tabs 18 thereon, the rear end portion of the shield 16 is covered by a dielectric cap 20 latched to the housing 10. A mating plug portion 21 of the plug connector 2 projects forwardly from the cap 20. A cable strain relief sleeve 22 surrounding the cable MC1 extends from the rear of the cap 20. The shield 16 has on each of two opposite faces thereof an outwardly convex central boss 24, only one of which is shown. As so far described, the plug 2 is constructed generally according to the teaching of U.S. Pat. No. 5,017,156 the disclosure of which is incorporated herein by reference. To the extent that the plug connector 2 has been so far described, the plug connector 4 is identical therewith, both of the plug connectors being according to IEE1394. Accordingly, those parts of the plug connector 4 which are identical with corresponding parts of the plug connector 2 bear the same reference numerals as those parts.

In the practice of the present embodiment of the invention, the cable MC1 which is terminated to the plug connector 2 is longer than the cable MC2 which is terminated to the plug 4. The wires of the cable MC1 are connected at their ends remote from the plug 2 to a first electrical circuit (not shown) and the wires of the cable MC2 are connected at their ends remote from the plug connector 4 to a second electrical circuit (not shown). The plug connector 2 is arranged, as will be described below, to be mateable only with the receptacle connector 6, the plug connector 4 being arranged to be mateable with either one of the receptacle connectors 6 or 8 as required. To these ends, the plug and receptacle connectors are provided with keying means which are described below.

Figure 8:
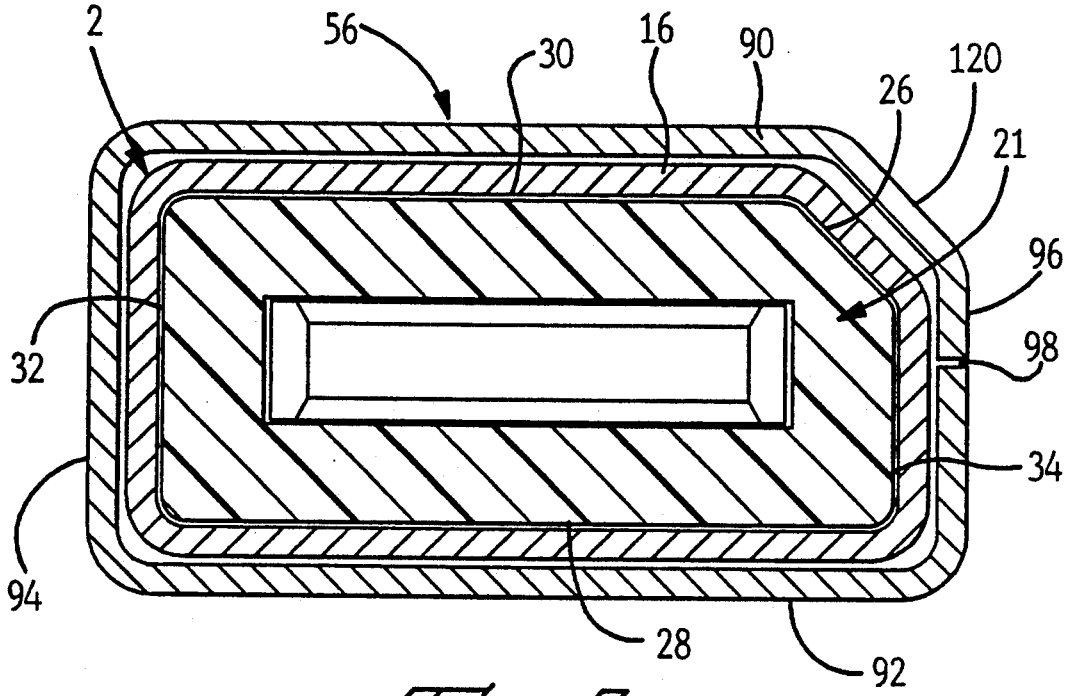
FIG. 8 is an enlarged cross sectional view showing the first plug connector when mated with the first receptacle connector, taken on the lines A—A in FIG. 1 through the first plug connector.
Figure 9:
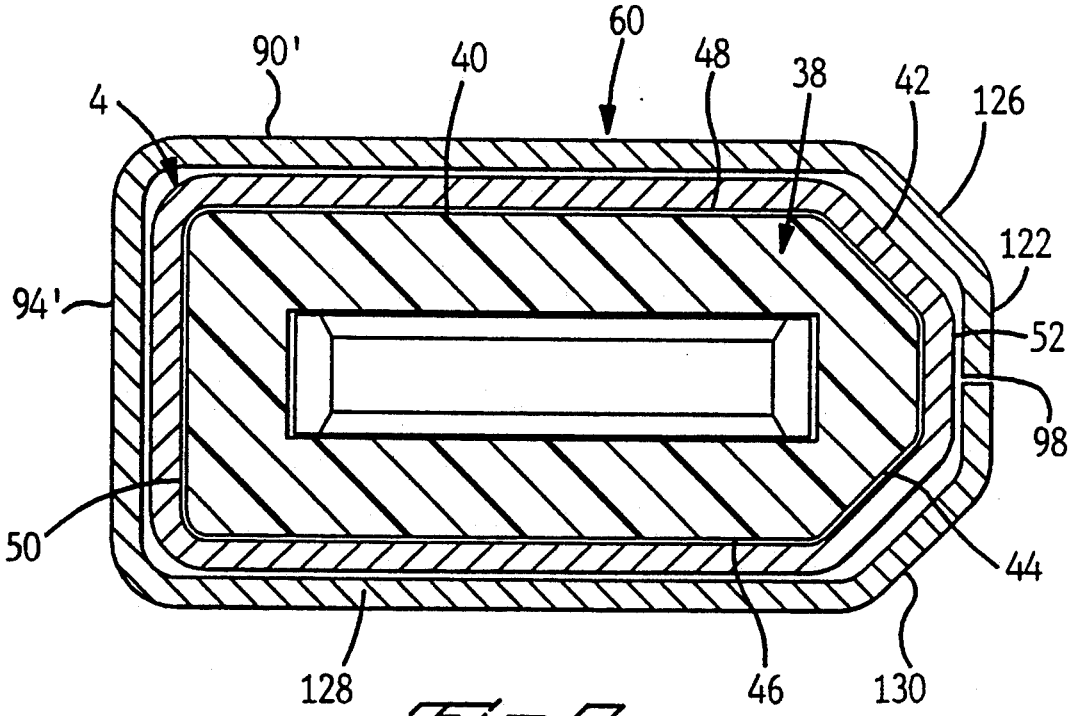
FIG. 9 is an enlarged cross sectional view showing the second plug connector when mated with the second receptacle connector, taken on the lines B—B in FIG. 3 through the second plug connector.

The keying means of the plug connector 2 will now be described with particular reference to FIGS. 1, 8 and 9. The mating portion 21 of the plug connector 2, which portion is otherwise of substantially rectangular, elongate cross section, has one of its corners chamfered to provide a flat 26 which extends along the whole length of the mating portion 21 from its forward or mating end to the cap 20. The other three corners of the portion 21 are rounded. The mating plug portion 21 has opposite major bottom and top faces 28 and 30, respectively, and opposite major side faces 32 and 34. As best seen in FIGS. 8 and 9, the width of the major face 28 is approximately 2 ¼ times the height of the minor side face 32, the width of the face 30 being approximately ⅛ less than that of the face 28 and the height of the face 34 being approximately ¾ of the height of the face 32 which is approximately half the width of the face 30. The flat 26 is angled by about 45° with respect to the face 30. The shield 16 fits snugly about the mating portion 21 and accordingly has the same configuration thereas and the same relative dimensioning of its faces. The shield 16 terminates a short distance back from the forward end part of the mating portion 21.

Figure 3:
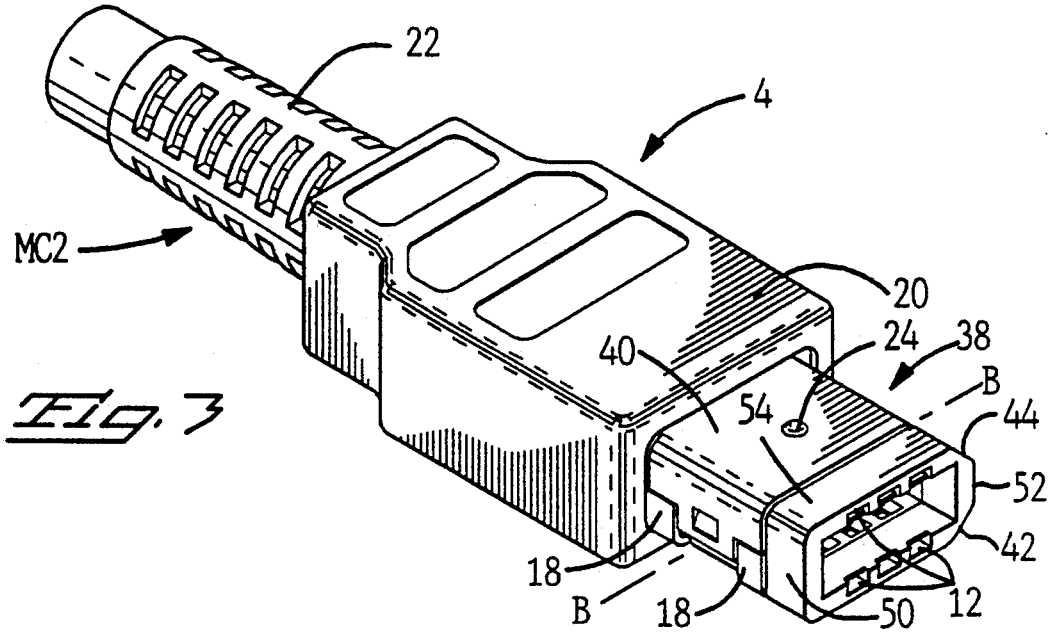
FIG. 3 is an isometric view of a second shielded electrical plug connector according to said preferred embodiment to which has been terminated a relatively short electrical cable only part of which is shown.
Figure 4:
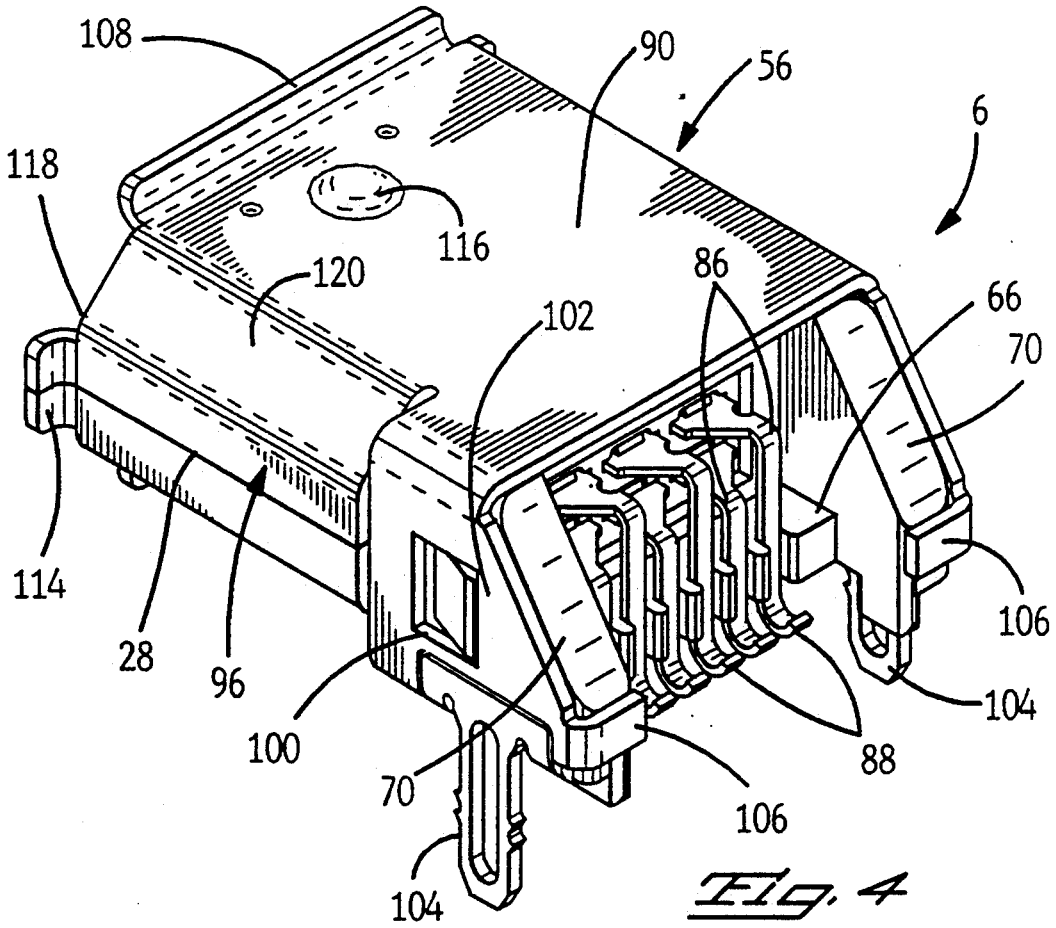
FIG. 4 is an isometric view taken from the rear of a first, shielded, surface mount electrical receptacle connector according to said preferred embodiment for mating only with said first plug connector.
Figure 5:
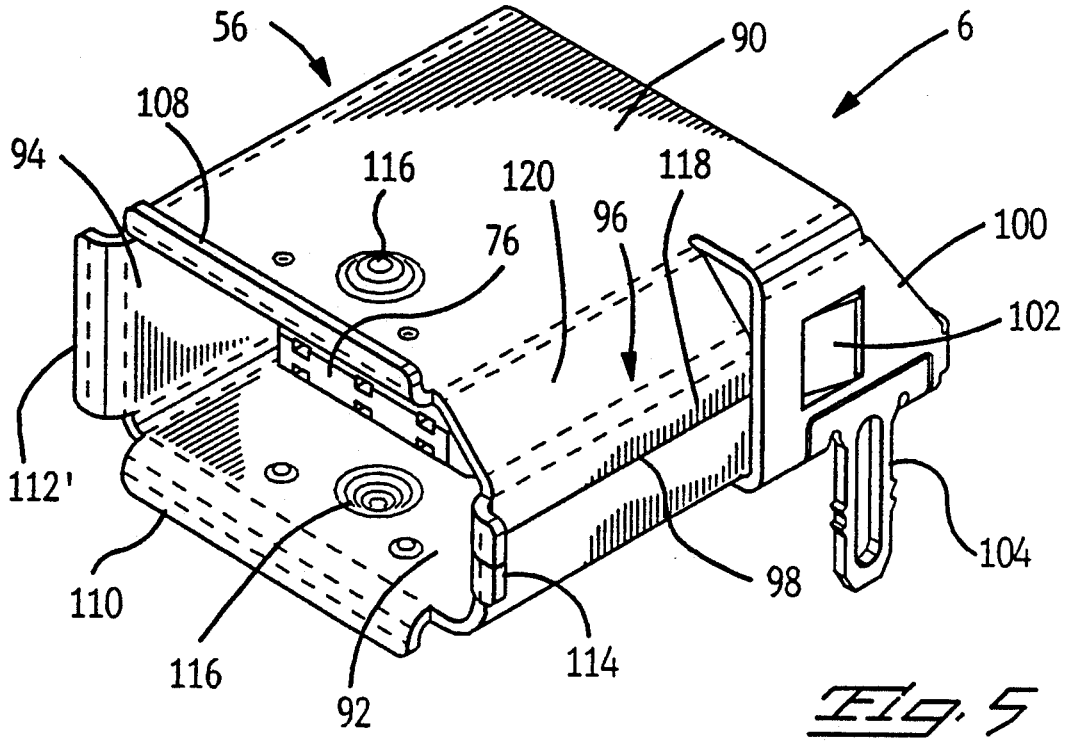
FIG. 5 is an isometric view taken from the front of the receptacle connector of FIG. 4.
Figure 10:
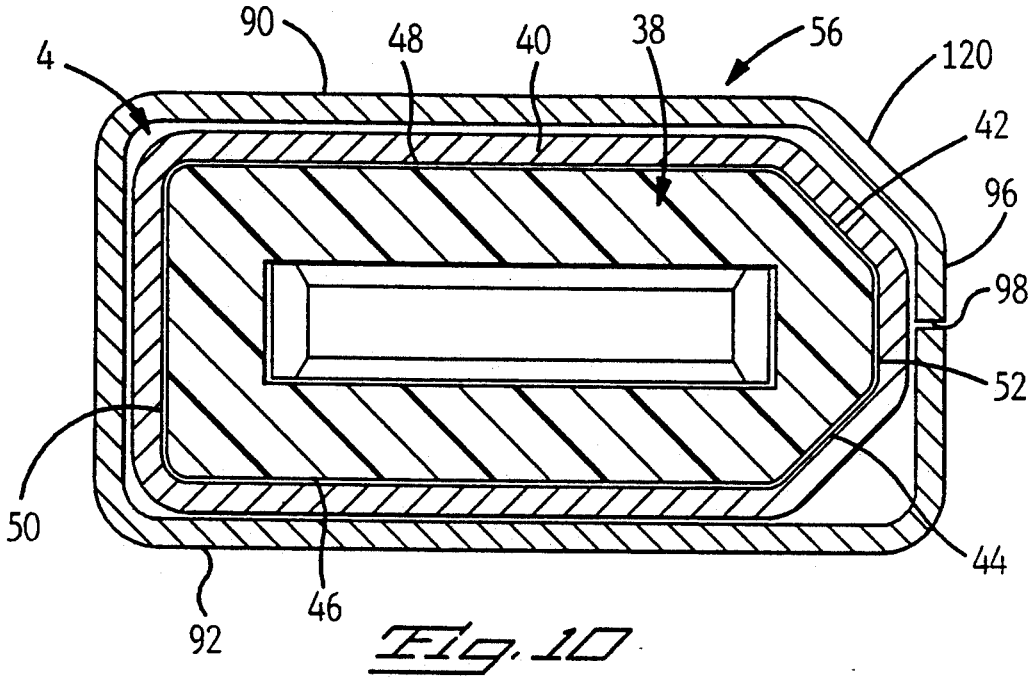
FIG. 10 is an enlarged cross sectional view showing the second plug connector when mated with the first receptacle connector, taken on the lines B—B in FIG. 3 through the second plug connector.

The keying means of the plug connector 4 will now be described with reference to FIGS. 3, 9 and 10. The plug connector 4 has a mating portion 38, the shield whereof is referenced 40. The mating portion 38 which is otherwise of substantially rectangular elongate cross section, has two opposite corners as will be seen in FIGS. 9 and 10, chamfered to provide two opposed and oppositely angled flats 42 and 44, respectively, of equal length, the flats 42 and 44 being each of the same length as the flat 26 of the mating portion 21 of the plug connector 2. By virtue of the flats 42 and 44, the mating portion 38 tapers leftwardly as seen in FIGS. 9 and 10. The flats 42 and 44 extend along the whole length of the mating portion 38 from its forward or mating end to the cap 20. As best seen in FIGS. 9 and 10, the mating portion 38 has two major top and bottom faces 46 and 48, respectively, of equal length, a minor side face 50 adjacent to the faces 46 and 48 and being of about half the width of the faces 46 and 48, and a minor side face 52 adjacent to the flats 42 and 44, the height of the side face 50 being approximately 3 ¾ times the height of the side face 52. The flat 42 is angled by about 45° with respect to the top face 48, the flat 44 being angled to the same extent with respect to the bottom face 46. The shield 40 fits snugly about the mating portion 38 and thus has the same configuration thereas and the same relative dimensions in respect of its top, bottom and side faces.

The width of the top face 30 of the mating portion 21 of the plug connector 2 is approximately equal to the width of each of the faces 46 and 48 of the mating portion 38 of the plug connector 4 and the height of the side face 32 of the mating portion 21 is approximately equal to that of the side face 50 of the mating portion 38.

Figure 6:
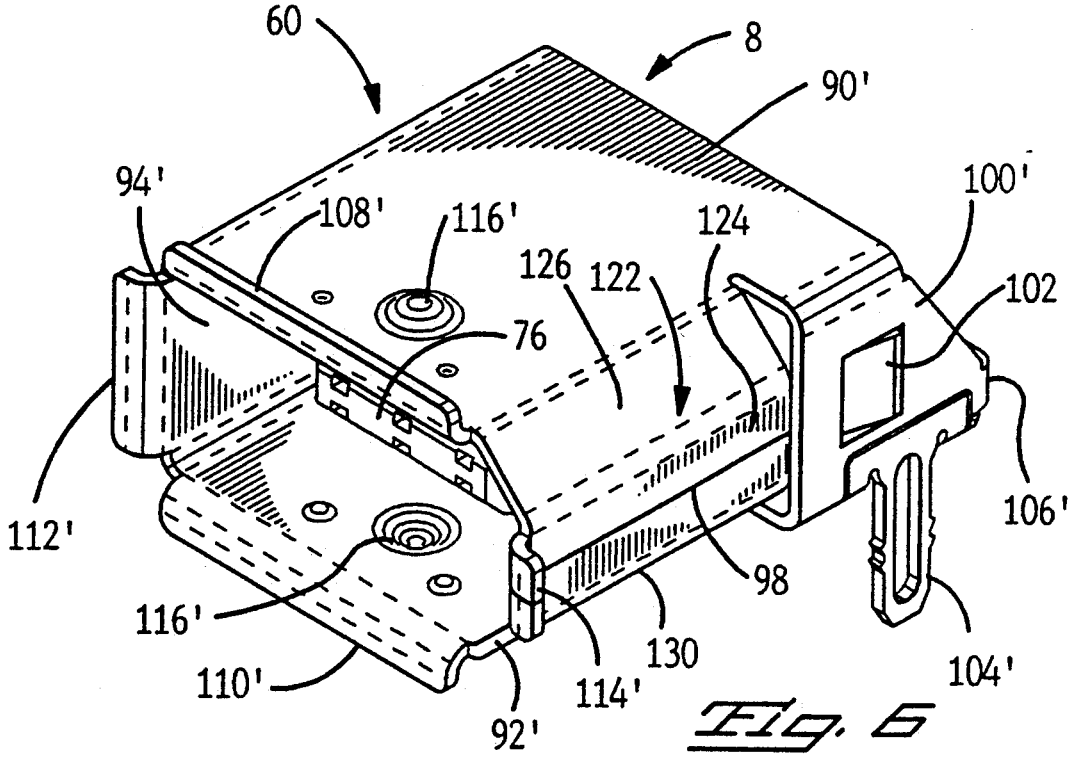
FIG. 6 is an isometric view taken from the front, of a second, shielded, surface mount electrical receptacle connector according to said preferred embodiment for mating with either of said first and second plug connectors as required.
Figure 7:
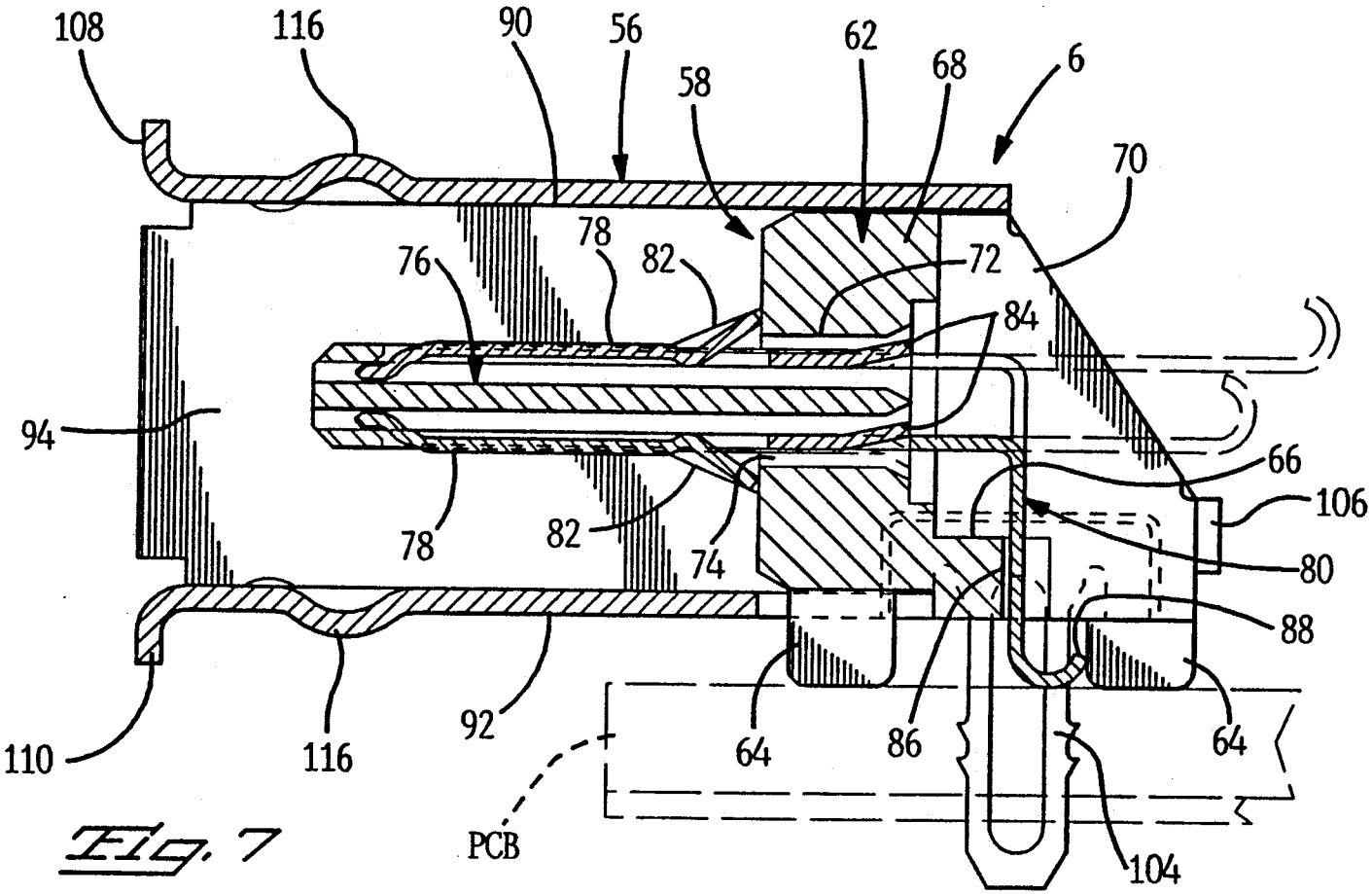
FIG. 7 is an enlarged longitudinal sectional view of the receptacle connector of FIGS. 4 and 5, when mounted on a printed circuit board which is shown diagrammatically in broken lines.

The shielded surface mount electrical receptacle connectors 6 and 8 will now be described with reference to FIGS. 4–11. Each connector 6 and 8, is, with the exception of its keying means, described below, constructed in accordance with the teaching of patent application Ser. No. 07/932,326 filed Aug. 27, 1992 (15376), the disclosure of which is hereby incorporated herein by reference. Each connector 6 and comprises a stamped, formed and rolled-up EMI metal shielding shell and an identical electrical terminal assembly 58 received in the shielding shell which provides a four sided, generally rectangular cross section enclosure for the terminal assembly 58. Since the assemblies 58 of the connectors 6 and 8 are identical, only that of the connector 6 is shown (FIG. 7). The shielding shell of the receptacle connector 6 is referenced 56 and that of the receptacle connector 8 is referenced 60, since these shells differ from each other in respect of their keying means which are described below.

The terminal assembly 58 comprises a dielectric housing 62 as best seen in FIG. 7, secured in the shielding shell 56 and having stand off studs 64 (only two of which are shown) for engaging the upper surface of the circuit board PCB. A terminal spacer comb 66 projects rearwardly from a main block 68 of the housing 62 above the studs 64 and between terminal tail protective cheeks 70 extending rearwardly from opposite sides of the block 68. There extend through the block 68, upper and lower terminal receiving cavities 72 and 74, respectively. There projects forwardly from the block 68, between the upper and lower cavities 72 and 74, a terminal support plate 76, the upper surface of which is formed with a row of upper, terminal receiving grooves and the lower surface of which is formed with a corresponding row of lower terminal receiving grooves. There is received in each groove, a rectilinear mating portion 78 of a respective electrical terminal 80, for mating with the contact spring 12 of a respective contact element of the plug connector 2 or 4, as the case may be. Each terminal 80 has a latching tongue 82 engaging the forward face of the block 68, a latching tongue 84 engaging a shoulder of the rear face of the block 68 and a contact tail engaged in a respective notch of the comb 66 and having a solder foot 88 for engaging a respective conductor on the board PCB.

Insofar as the shells 56 and 60 are identical with each other, the shell 56 will now be described, those parts of the shell 60 which are identical with corresponding parts of the shell 56 bearing the same reference numerals thereas but with the addition of a prime symbol.

The shell 56 comprises planar, parallel top and bottom walls 90 and 92, respectively, a first planar side wall 94 adjacent to, and extending at right angles to, the top and bottom walls 90 and 92 and a second side wall 96 opposite to the side wall 94 and having a longitudinal seam 98. The top wall 90 has depending therefrom a bent down flange 100. The side wall 94 and the flange 100 each have a latching opening receiving a respective latch member 102 on the block 68 of the housing 62. The side wall 94 and the flange 100 each have depending therefrom a barbed mounting post 104 for securing the connector 6 to the circuit board PCB. The side wall 94 and the flange 100 are each provided with a tab 106 secured against a respective cheek 70 of the housing 62. At their forward ends, the walls 90, 92, 94 and 96, have respective outwardly turned plug portion guide flanges, 108, 110, 112 and 114, respectively. Outwardly convex, laterally central dimples 116 for latching engagement with a respective one of the plug portion bosses 24, are formed in the forward parts of the top and bottom walls 90 and 92.

The keying means of the shell 56 and thus of the connector 6 will now be described. The side 96, which is parallel to the side wall 94 and is orthogonal with respect to the walls 90 and 92, is connected to the top wall 90 by a chamfer in the form of a flat 120 which extends at an angle of approximately 45° with respect to the wall 90 as best seen in FIGS. 8 and 10. The shell 56 is accordingly of substantially rectangular cross section having a single chamfered corner. The remaining corners of the shell 56 are rounded. The width of the wall 90 is approximately 9/10ths of the width of the wall 92, the height of the wall 96 being about half the height of the wall 94.

The keying means of the shell 60 will now be described with particular reference to FIGS. 6 and 9. The second side wall of the shell 60, which is referenced 122, is planar and is parallel with the side wall 94' and includes the seam 98 of the shell 60. The side wall 122 is connected to the top wall 90' of the shell 60 by a chamfer in the form of a first flat 126 and is connected to the bottom wall, which is referenced 128, of the shell 60 by a chamfer in the form of a second flat 130. The flats 126 and 130 are identically dimensioned but are oppositely angled, the flat 126 being angled by approximately 45° with respect to the top wall 90' and the flat 130 being angled by approximately 45° with respect to the bottom wall 128. The top wall 90' and the bottom wall 128 are of equal width. The top walls 90 and 90' of the shells 56 and 60, respectively, are of equal width and the side walls 94 and 94' of the shells 56 and 50, respectively, are of equal height.

Since the side walls 96 and 122 are each divided by a seam 98, the flats 120, 126 and 130 can readily be formed before the shells 56 and 60 are rolled up, without being distorted during the rolling process.

Figure 11:
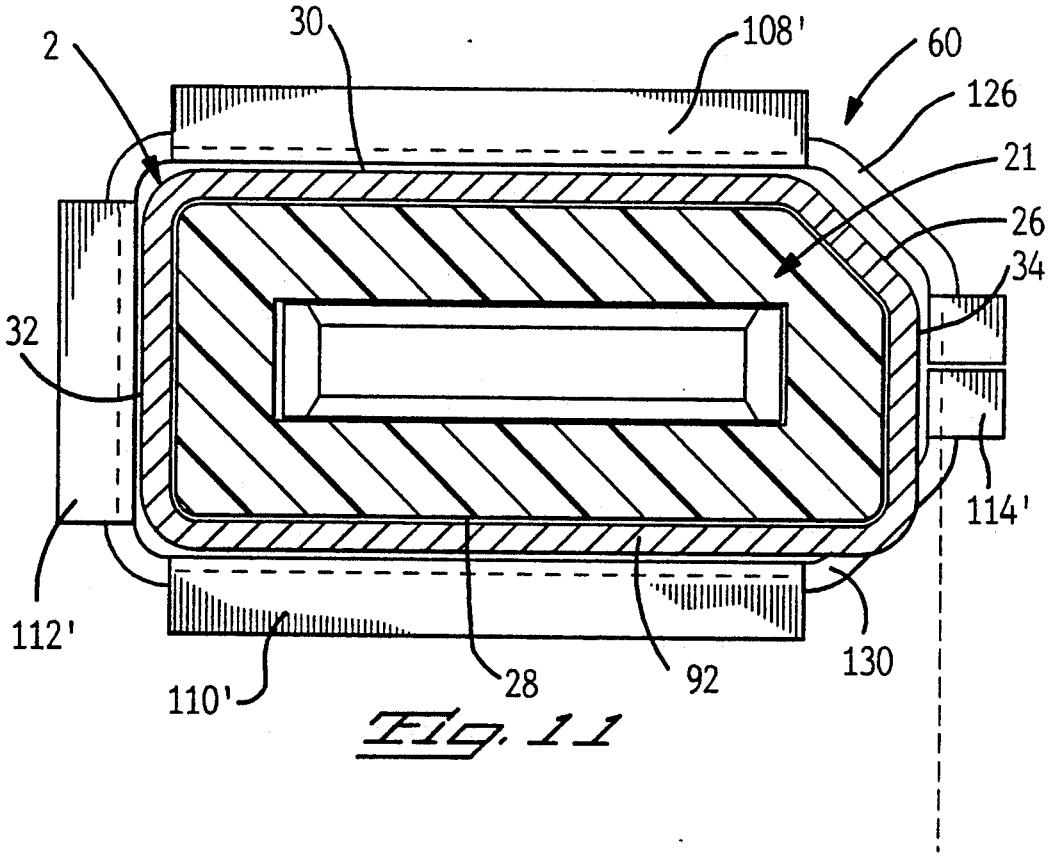
FIG. 11 is an enlarged front end view of the second receptacle connector and a cross sectional view of the first plug connector taken on the lines A—A in FIG. 1 through the first plug connector and illustrating an unsuccessful attempt to mate a first plug connector with the second receptacle connector.

As shown in FIG. 8, the mating portion 21 of the plug connector 2, which is connected to the longer cable MC1 can be mated with the shell 56 of the connector 6, because both are of exactly the same cross sectional shape, each wall dimension of the shield 16 of the plug connector 2 being slightly less than the corresponding wall dimension of the shell 56. The mating portion 21 and the shell 56 can only be mated, however, provided that the portion 21 and the shell 56 are so relatively angularly oriented that the flats 26 and 120 are in substantial alignment. The keying means of the portion 21 and of the shell 56 accordingly act also as polarizing means. The mating portion 21 of the plug connector 2 cannot, however, be mated with the shell 60, since, as will be apparent from FIG. 11 the flat 130 of the shell 60 would obstruct the bottom right hand corner (as seen in FIG. 11) of the mating portion 21 even if the portion 21 and the shell 60 were relatively angularly oriented with the flat 26 of the portion 21 in substantial alignment with the flat 126 of the shell 60.

The mating portion 38 of the plug connector 4 connected to the shorter cable MC2 can, however, be mated with either of the shells 56 and 60, as required, as will be apparent from FIGS. 9 and 10. The mating portion 38 of the plug connector 4 can mate with the shell 60 of the receptacle connector 8, since the shield 40, the mating portion 38 and the shell 60 of the connector 8 are of the same cross sectional shape, each wall dimension of the shield 40 being slightly less than the corresponding wall dimension of the shell 60, whereby the mating portion 38 and the shell 60 can be mated provided that they are relatively angularly oriented with the flat 42 in substantial alignment with the flat 126 and the flat 44 in substantial alignment with the flat 130, as shown in FIG. 9. The mating portion 38 of the plug connector 2 can be mated with the shell 56 of the receptacle connector 6 since both of the transverse maximum cross sections of the mating portion 38 are slightly less than those of the interior of the shell 56, as will be apparent from FIG. 10. In order to enable a mating of the portion 38 and the shell 56 they must be, however, relatively angularly oriented with the flat 42 of the portion 38 in substantial alignment with the flat 120 of the shell 56.

Upon mating the plug connector 2 with the receptacle connector 6 or upon mating the plug connector 4 with the receptacle connector 6 or 8, the mating portion of the plug connector is guided into the shielding shell of the receptacle connector by the flanges 108, 110, 112 and 114 of the shielding shell until the bosses 24 of the mating portion snap into engagement with the dimples 116 or 116', as the case may be, of the shielding shell, the contact springs 112 of the plug connector having slid into mating relationship with respective mating portions 78 of the terminals 80 of the receptacle connector.

For some applications the mating receptacle portions of the receptacle connectors may be dielectric hoods instead of metal shielding shells, the mating portions of the plug connectors being unshielded and the hoods having keying flats as described above in respect of the shielding shells.

What is claimed is:

1. A set of keyed electrical connectors each having electrical terminals secured therein, the set of connectors comprising a first and a second plug connector and a first and a second receptacle connector, each plug connector having a mating plug portion and each receptacle connector having a mating receptacle portion for mating with the mating portion of a respective plug connector to mate the electrical terminals of the plug connector with those of the receptacle connector, the mating portions of the connectors being formed with lateral chamfered keying surfaces which are located to allow the terminals of the first plug connector to be mated only with the terminals of the first receptacle connector, but to allow the terminals of the second plug connector to be mated either with the terminals of the first receptacle connector or with the terminals of the second receptacle connector.

2. A set of connectors as claimed in claim 1, wherein each of the mating portions is elongate and is of substantially rectangular cross section, the mating portion of the first plug connector and the mating portion of the first receptacle connector having one of its corners chamfered, the mating portion of the second plug connector and the mating portion of the second receptacle connector having two opposed chamfered corners at the same end of the cross section of the mating portion, which corners are oppositely angled.

3. A set of connectors as claimed in claim 1, wherein the mating portion of each plug connector is snugly surrounded by a metal shield, the mating portion of each receptacle connector being in the form of a metal shielding shell containing an electrical terminal assembly, mating contact springs of the terminals of the receptacle connector projecting from said assembly towards an open mating end of the shielding shell, the terminals of each receptacle connector having contact tails for soldering to conductors on a circuit board and the terminals of each plug connector having means for connection to wires of an electrical cable.

4. A set of connectors as claimed in claim 1, wherein the terminals of the first plug connector are connected by way of a first electrical cable to a first electrical circuit, the terminals of the second plug connector being connected by way of a second electrical cable to a second electrical circuit, the first and second cables being of different lengths and the terminals of the first receptacle connector being connected to conductors of a first printed circuit and the terminals of the second receptacle connector being connected to conductors of a second printed circuit.

5. A set of keyed electrical connectors each having electrical terminals secured therein, the set of connectors comprising a first and a second plug connector and a first and a second receptacle connector, each plug connector having a shielded mating plug portion and each receptacle connector having a metal shielding shell for receiving the mating portion of a respective plug connector in a mating direction, to mate the electrical terminals of the plug connector with those of the receptacle connector, the mating portions of the plug connectors and the shielding shells of the receptacle connectors being formed with keying surfaces which are inclined transversely of the mating direction and are located to allow the mating portion of the first plug connector to be received in the shielding shell of the first receptacle connector, to prohibit the mating portion of the first plug connector from being received in the shielding shell of the second receptacle connector and to allow the mating portion of the second plug connector to be received either in the shielding shell of the first receptacle connector or in the shielding shell of the second receptacle connector.

6. A set of connectors as claimed in claim 5 wherein the terminals of the first plug connector are connected to respective wires of a first electrical cable and the terminals of the second plug connector are connected to respective wires of a second electrical cable, one of said cables being longer than the other cable, each of the receptacle connectors being surface mounted on a circuit board and the terminals of the first and second receptacle connectors being connected to respective discrete printed circuits.

7. A set of connectors as claimed in claim 5, wherein the mating portion of the first plug connector and the shielding shell of the first receptacle connector each have a first one of said inclined keying surfaces, the mating portion of the second plug connector and the shielding shell of the second receptacle connector, each having a pair of opposed and oppositely angled second ones of said inclined keying surfaces.

8. A set of connectors as claimed in claim 7, wherein the mating portion of the first plug connector is receivable in the shielding shell of the first receptacle connector with the inclined keying surfaces of that shielding shell and of that mating portion facing each other in substantially parallel relationship, the mating portion of the second plug connector being receivable in the shielding shell of the first receptacle connector with one of the inclined keying surfaces of that mating portion in facing, substantially parallel relationship with the inclined keying surface of that shielding shell, and the mating portion of the second plug connector being receivable in the shielding shell of the second receptacle connector with each inclined keying surface of that mating portion in facing, substantially parallel relationship with a respective one of the inclined keying surfaces of that shielding shell.

9. A set of connectors as claimed in claim 7, wherein each mating portion has opposite top and bottom faces and opposite side faces, each metal shielding shell having opposite top and bottom walls and opposite side walls, the inclined keying surface of the mating portion of the first plug connector joining one side face of that mating portion to the top face thereof, the inclined keying surface of the shielding shell of the first receptacle connector, joining one side wall of that shielding shell to the top wall thereof, one inclined keying surface of the mating portion of the second plug connector joining one side face of that mating portion to the top face thereof and the other inclined keying surface of the mating portion of the second plug connector joining the one side face to the bottom face of that mating portion, one inclined keying surface of the shielding shell of the second receptacle connector joining one side wall of that shielding shell to the top wall thereof and the other inclined keying surface of that shielding shell joining the one side wall to the bottom wall of that shielding shell.

10. A set of connectors as claimed in claim 9, wherein said one side wall of each of said shielding shells is divided by a seam extending in said mating direction.

11. A set of keyed electrical connectors comprising first and second plug connectors and first and second receptacle connectors, the plug connectors having respective first and second elongate plug portions of a cross sectional shape and the receptacle connectors having first and second elongate receptacle portions, each plug portion having opposed top and bottom faces and opposed first and second side faces and a mating end, the first side face being of greater height than the second side face and being directly connected to said top and bottom faces, each receptacle portion having opposed top and bottom walls, first and second opposed side walls, and a mating end, the first wall being of greater height than the second side wall and directly connected to said top and bottom walls;

wherein the second side face of each plug portion is connected to the top side face thereof by a first chamfer extending rearwardly from the mating end of the plug portion, the second side wall of each receptacle portion being connected to the top wall thereof by a first flat which is angled with respect to the top wall and the end wall and extends rearwardly from the mating end of the receptacle portion, the second side face of the first plug portion being directly connected to the bottom face thereof, the second side wall of the first receptacle portion being directly connected to the bottom wall thereof, the second side face of the second plug portion being connected to the bottom face thereof by a second chamfer extending rearwardly from the mating end of the second plug portion and being oppositely angled with respect to said first chamfer, the second side wall of the second receptacle portion being connected to the bottom wall thereof by a second flat which extends rearwardly from the mating end of the second receptacle portion and is oppositely angled with respect to the first flat; and wherein the first plug portion is mateable with the first receptacle portion with the chamfer of the first plug portion in substantial alignment with the flat of the first receptacle portion, the second plug portion being mateable with the first receptacle portion with the first chamfer of the second plug portion in substantial alignment with the flat of the first receptacle portion, the second plug portion being mateable with the second receptacle portion with the first and second chamfers of the second plug portion in substantial alignment with the respective first and second flats of the second receptacle portion, the first plug portion being unmateable with the second receptacle portion.

12. A set of connectors as claimed in claim 11, wherein the side faces of each plug portion are orthogonal with respect to the top and bottom faces thereof, the side walls of each receptacle portion being orthogonal with respect to the top and bottom walls thereof.

13. A set of connectors as claimed in claim 11, wherein the first chamfers of the plug portions are equally inclined by a given angle with respect to the top faces of the plug portions, the first flats of the receptacle portions being equally inclined by said given angle with respect to the top walls of the receptacle portions, the second chamfer of the second plug portion being inclined by said given angle with respect to the bottom face of the second plug portion and the second flat of the second receptacle being inclined by said given angle with respect to the bottom wall thereof.

14. A set of connectors as claimed in claim 13, wherein said given angle is 45°.

15. A set of connectors as claimed in claim 13, wherein the top faces of the plug portions are of equal width, the top walls of the receptacle portions being of equal width, and the top and bottom faces of the second plug portion being of equal width.

16. A set of connections as claimed in claim 11, wherein said top and bottom faces are major faces, said side faces being minor faces, said top and bottom walls being major walls and said side walls being minor walls.

17. A set of connectors as claimed in claim 11, wherein each plug portion is surrounded by a metal shield closely confined to the cross sectional shape of the plug portion, each receptacle portion being in the form of a metal shielding shell.

18. A set of connectors as claimed in claim 17, wherein the second side wall of each receptacle portion is divided by a seam extending longitudinally thereof.

19. A set of connectors as claimed in claim 11, wherein a cable of a first length is terminated to the first plug connector, a cable of a second length which is different from said first length being terminated to the second plug connector.

20. A set of connectors as claimed in claim 11, wherein the width of the top face of each plug portion is about 2 ¼ times the height of the first side face thereof, the width of the top face of the first plug portion being less than that of the bottom face thereof, by about ⅛th, the widths of the top and bottom faces of the second plug portion being approximately equal and the height of the first side face of the second plug portion being about 3 ¾ times that of the second side face of the second plug portion, the relative dimensions of the top and bottom walls and the side walls of the first and second receptacle portions being substantially the same as those of the top and bottom faces and the side faces of the plug portions.

* * * * *